US008325123B2

(12) United States Patent
Li et al.

(10) Patent No.: US 8,325,123 B2
(45) Date of Patent: Dec. 4, 2012

(54) LIQUID CRYSTAL DISPLAY DEVICE WITH ADAPTIVE CHARGING/DISCHARGING TIME AND RELATED DRIVING METHOD

(75) Inventors: Ling Li, Hualien (TW); Shian-Jun Chiou, Taipei (TW); Ying-Hui Chen, Taoyuan (TW); Chi-Neng Mo, Taoyuan County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 420 days.

(21) Appl. No.: 12/716,275

(22) Filed: Mar. 3, 2010

(65) Prior Publication Data

US 2011/0122106 A1 May 26, 2011

(30) Foreign Application Priority Data

Nov. 26, 2009 (TW) ..... 98140317 A

(51) Int. Cl.
*G09G 3/36* (2006.01)

(52) U.S. Cl. ..... 345/89; 345/205; 345/690; 345/98; 345/204; 345/99

(58) Field of Classification Search ..... 345/690, 345/99, 89, 204, 205, 98
See application file for complete search history.

(56) References Cited

U.S. PATENT DOCUMENTS

| | | | | |
|---|---|---|---|---|
| 2003/0006979 | A1 * | 1/2003 | Tsuchi et al. | 345/204 |
| 2006/0146005 | A1 * | 7/2006 | Baba et al. | 345/102 |
| 2007/0126723 | A1 * | 6/2007 | Hong | 345/204 |
| 2007/0171317 | A1 * | 7/2007 | Ho et al. | 349/6 |

FOREIGN PATENT DOCUMENTS

| | | | |
|---|---|---|---|
| CN | 1979627 | A | 6/2007 |
| JP | H0844318 | A | 2/1996 |
| JP | 200075839 | A | 3/2000 |
| JP | 2008209890 | A | 9/2008 |
| JP | 2009128414 | A | 6/2009 |

* cited by examiner

*Primary Examiner* — Lun-Yi Lao
*Assistant Examiner* — Shaheda Abdin
(74) *Attorney, Agent, or Firm* — Winston Hsu; Scott Margo

(57) ABSTRACT

A liquid crystal display device includes a plurality of gate lines, a plurality of data lines, a pixel array, a gate driver, a timing controller, and an optimization circuit. Each pixel unit in the pixel array displays images according to the gate driving signal received from a corresponding gate line and the data driving signal received from a corresponding data line. According to an optimized reference value, the timing controller provides an output enable signal, based on which the gate driver outputs the gate driving signals. The optimization circuit receives a first grayscale data related to display images of a row of pixel units in a first driving period and a second grayscale data related to display images of the row of pixel units in a second driving period, and provides the optimized reference value according the difference between the first and second grayscale data.

3 Claims, 10 Drawing Sheets

| | | Previous grayscale value | | | | | | | | | |
|---|---|---|---|---|---|---|---|---|---|---|---|
| | | 0-15 | 16-31 | 32-47 | 48-63 | 64-79 | 80-95 | .... | 208-223 | 224-239 | 240-255 |
| Target grayscale value | 0-15 | 2 us | 1 us | 1 us | 1 us | 1 us | 1 us | .... | 1 us | 1 us | 1 us |
| | 16-31 | 0.5 us | 2 us | 1 us | 1 us | 1 us | 1 us | .... | 1 us | 1 us | 1 us |
| | 32-47 | 0.5 us | 0.5 us | 2 us | 1 us | 1 us | 1 us | .... | 1 us | 1 us | 1 us |
| | 48-63 | 0.5 us | 0.5 us | 0.5 us | 2 us | 1 us | 1 us | .... | 1 us | 1 us | 1 us |
| | 64-79 | 0.5 us | 0.5 us | 0.5 us | 0.5 us | 2 us | 1 us | .... | 1 us | 1 us | 1 us |
| | 80-95 | 0.5 us | 0.5 us | 0.5 us | 0.5 us | 0.5 us | 2 us | .... | 1 us | 1 us | 1 us |
| | ⋮ | ⋮ | ⋮ | ⋮ | ⋮ | ⋮ | ⋮ | .... | ⋮ | ⋮ | ⋮ |
| | 208-223 | 0.5 us | 0.5 us | 0.5 us | 0.5 us | 0.5 us | 0.5 us | .... | 2 us | 1 us | 1 us |
| | 224-239 | 0.5 us | 0.5 us | 0.5 us | 0.5 us | 0.5 us | 0.5 us | .... | 0.5 us | 2 us | 1 us |
| | 240-255 | 0.5 us | 0.5 us | 0.5 us | 0.5 us | 0.5 us | 0.5 us | .... | 0.5 us | 0.5 us | 2 us |

FIG. 8

| | | Previous grayscale value | | | | | | | | | |
|---|---|---|---|---|---|---|---|---|---|---|---|
| | | 0 | 1 | 2 | 3 | 4 | 5 | .... | 253 | 254 | 255 |
| Target grayscale value | 0 | 2 us | 1 us | 1 us | 1 us | 1 us | 1 us | .... | 1 us | 1 us | 1 us |
| | 1 | 0.5 us | 2 us | 1 us | 1 us | 1 us | 1 us | .... | 1 us | 1 us | 1 us |
| | 2 | 0.5 us | 0.5 us | 2 us | 1 us | 1 us | 1 us | .... | 1 us | 1 us | 1 us |
| | 3 | 0.5 us | 0.5 us | 0.5 us | 2 us | 1 us | 1 us | .... | 1 us | 1 us | 1 us |
| | 4 | 0.5 us | 0.5 us | 0.5 us | 0.5 us | 2 us | 1 us | .... | 1 us | 1 us | 1 us |
| | 5 | 0.5 us | 0.5 us | 0.5 us | 0.5 us | 0.5 us | 2 us | .... | 1 us | 1 us | 1 us |
| | ⋮ | ⋮ | ⋮ | ⋮ | ⋮ | ⋮ | ⋮ | .... | ⋮ | ⋮ | ⋮ |
| | 253 | 0.5 us | 0.5 us | 0.5 us | 0.5 us | 0.5 us | 0.5 us | .... | 2 us | 1 us | 1 us |
| | 254 | 0.5 us | 0.5 us | 0.5 us | 0.5 us | 0.5 us | 0.5 us | .... | 0.5 us | 2 us | 1 us |
| | 255 | 0.5 us | 0.5 us | 0.5 us | 0.5 us | 0.5 us | 0.5 us | .... | 0.5 us | 0.5 us | 2 us |

FIG. 9

| | | Previous grayscale value | | | | | | | | | |
|---|---|---|---|---|---|---|---|---|---|---|---|
| | | 0 | 1 | 2 | 3 | 4 | 5 | .... | 253 | 254 | 255 |
| Target grayscale value | 0 | $T_{MAX}$ | $T_0$ | $T_0$ | $T_0$ | $T_0$ | $T_0$ | .... | $T_0$ | $T_0$ | $T_0$ |
| | 1 | $T_1$ | $T_{MAX}$ | $T_0$ | $T_0$ | $T_0$ | $T_0$ | .... | $T_0$ | $T_0$ | $T_0$ |
| | 2 | $T_2$ | $T_1$ | $T_{MAX}$ | $T_0$ | $T_0$ | $T_0$ | .... | $T_0$ | $T_0$ | $T_0$ |
| | 3 | $T_3$ | $T_2$ | $T_1$ | $T_{MAX}$ | $T_0$ | $T_0$ | .... | $T_0$ | $T_0$ | $T_0$ |
| | 4 | $T_4$ | $T_3$ | $T_2$ | $T_1$ | $T_{MAX}$ | $T_0$ | .... | $T_0$ | $T_0$ | $T_0$ |
| | 5 | $T_5$ | $T_4$ | $T_3$ | $T_2$ | $T_1$ | $T_{MAX}$ | .... | $T_0$ | $T_0$ | $T_0$ |
| | ⋮ | ⋮ | ⋮ | ⋮ | ⋮ | ⋮ | ⋮ | .... | ⋮ | ⋮ | ⋮ |
| | 253 | $T_{253}$ | $T_{252}$ | $T_{251}$ | $T_{250}$ | $T_{249}$ | $T_{248}$ | .... | $T_{MAX}$ | $T_0$ | $T_0$ |
| | 254 | $T_{254}$ | $T_{253}$ | $T_{252}$ | $T_{251}$ | $T_{250}$ | $T_{249}$ | .... | $T_1$ | $T_{MAX}$ | $T_0$ |
| | 255 | $T_{255}$ | $T_{254}$ | $T_{253}$ | $T_{252}$ | $T_{251}$ | $T_{250}$ | .... | $T_2$ | $T_1$ | $T_{MAX}$ |

FIG. 10

LIQUID CRYSTAL DISPLAY DEVICE WITH ADAPTIVE CHARGING/DISCHARGING TIME AND RELATED DRIVING METHOD

BACKGROUND OF THE INVENTION

1. Field of the Invention

The present invention is related to a liquid crystal display device and a related driving method, and more particularly, to a liquid crystal display device with adaptive charging/discharging time and a related driving method.

2. Description of the Prior Art

Liquid crystal display (LCD) devices, characterized in low radiation, small size and low power consumption, have gradually replaced traditional cathode ray tube (CPT) displays and been widely used in electronic products such as notebook computers, personal digital assistants (PDAs), flat panel TVs, or mobile phones. An LCD device displays images by driving the pixels of the panel using a source driver and a gate driver. Based on driving modes, the LCD device can adopt single-gate pixel layout or double-gate pixel layout. When compared to an LCD panel having single-gate pixel layout under the same resolution, the number of gate lines is doubled and the number of data lines is halved in an LCD panel having double-gate pixel layout, therefore requiring more gate driver chips and fewer source driver chips. Since gate driver chips are less expensive and consume less power, double-gate pixel layout can lower manufacturing costs and power consumption.

FIG. 1 is a diagram illustrating a prior art LCD device 100. The LCD device 100 includes an LCD panel 110, a source driver 120, a gate driver 130, and a timing controller 140. A plurality of data lines $DL_1$-$DL_m$, a plurality of gate lines $GL_1$-$GL_n$, and a pixel array are disposed on the LCD panel 110. The pixel array includes a plurality of pixel units $P_{11}$-$P_{mn}$ (m and n are positive integers) each having a thin film transistor switch TFT, a liquid crystal capacitor $C_{LC}$ and a storage capacitor $C_{ST}$. Each pixel unit is coupled to a corresponding data line, a corresponding gate line, and a common voltage $V_{COM}$. In the LCD device 100, the pixel units $P_{11}$-$P_{mn}$ receive data signals from corresponding data lines disposed at the left side. The timing controller 140 is configured to generate control signals for operating the source driver 120 and the gate driver 130, such as a start pulse signal VST, a horizontal synchronization signal HSYNC, and a vertical synchronization signal VSYNC. According to the start pulse signal VST and the vertical synchronization signal VSYNC, the gate driver 130 respectively outputs gate driving signals $SG_1$-$SG_n$ to the gate lines $GL_1$-$GL_n$, thereby turning on the thin film transistor switches TFT in the corresponding rows of pixel units. According to the horizontal synchronization signal HSYNC, the source driver 120 respectively outputs data driving signals $SD_1$-$SD_m$ related to display images to the data lines $DL_1$-$DL_m$, thereby charging the liquid crystal capacitors $C_{LC}$ and the storage capacitors $C_{ST}$ in the corresponding columns of pixel units. In the LCD device 100, the type and polarity of each pixel unit are represented by "R" (red pixel), "G" (green pixel), B" (blue pixel), "+" (positive polarity) and "−" (negative polarity) in FIG. 1. In order to achieve dot inversion in the LCD device 100, the data driving signals outputted to each pixel unit need to be inverted periodically, thereby consuming a lot of power.

Reference is made to FIG. 2 for a timing diagram illustrating the operation of the LCD device 100. In FIG. 2, SG represents the waveform of the gate driving signal, SD represents the waveform of the data driving signal, and $V_{PIXEL}$ represents the voltage level of the pixel unit. The grayscale value of a display image of the pixel unit is determined by the voltage difference between the data driving signal SD and the common voltage $V_{COM}$. During the charging period $T_C$, the high-level gate driving signal turns on the thin film transistor switches TFT in the corresponding pixel units. The data signal SD can thus be written into the liquid crystal capacitor $C_{LC}$ and the storage capacitor $C_{ST}$ in the corresponding pixel units, thereby changing the voltage levels of the corresponding pixel units. In high-resolution applications, the LCD device 100 needs to adopt more gate lines. Therefore, the charging period $T_C$ of each pixel unit is shortened and the pixel units may not have sufficient time to reach the predetermine level $V_{GH}$ or $V_{GL}$.

FIG. 3 is a diagram illustrating another prior art LCD device 200. The LCD device 200 includes an LCD panel 210, a source driver 220, a gate driver 230, and a timing controller 240. A plurality of data lines $DL_1$-$DL_{m+1}$, a plurality of gate lines $GL_1$-$GL_n$, and a pixel array are disposed on the LCD panel 210. The pixel array includes a plurality of pixel units $P_{11}$-$P_{mn}$ (m and n are positive integers) each having a thin film transistor switch TFT, a liquid crystal capacitor $C_{LC}$ and a storage capacitor $C_{ST}$. Each pixel unit is coupled to a corresponding data line, a corresponding gate line, and a common voltage $V_{COM}$. The LCD device 200 adopts a zigzag layout in which the odd-numbered rows of pixel units $P_{11}$-$P_{m1}$, $P_{13}$-$P_{m3}$, . . . , $P_{1(n-1)}$-$P_{m(n-1)}$ receive data signals from corresponding data lines disposed at the left side, while the even-numbered rows of pixel units $P_{12}$-$P_{m2}$, $P_{14}$-$P_{m4}$, . . . , $P_{1n}$-$P_{mn}$ receive data signals from corresponding data lines disposed at the right side (assuming n is an even number). The timing controller 240 is configured to generate control signals for operating the source driver 220 and the gate driver 230, such as a start pulse signal VST, a horizontal synchronization signal HSYNC, and a vertical synchronization signal VSYNC. According to the start pulse signal VST and the vertical synchronization signal VSYNC, the gate driver 230 respectively outputs gate driving signals $SG_1$-$SG_n$ to the gate lines $GL_1$-$GL_n$, thereby turning on the thin film transistor switches TFT in the corresponding rows of pixel units. According to the horizontal synchronization signal HSYNC, the source driver 220 respectively outputs data driving signals $SD_1$-$SD_{m+1}$, related to display images to the data lines $DL_1$-$DL_{m+1}$, thereby charging the liquid crystal capacitors $C_{LC}$ and the storage capacitors $C_{ST}$ in the corresponding columns of pixel units. In the LCD device 200, the type and polarity of each pixel unit are represented by "R" (red pixel), "G" (green pixel), B" (blue pixel), "+" (positive polarity) and "−" (negative polarity) in FIG. 3. In order to achieve dot inversion in the LCD device 200, the data driving signals outputted to each column of pixel units are inverted periodically, thereby consuming less power when compared to the LCD device 100.

Reference is made to FIG. 4 for a timing diagram illustrating the operation of the LCD device 200. In FIG. 4, SG represents the waveform of the gate driving signal, SD represents the waveform of the data driving signal, and $V_{PIXEL}$ represents the voltage level of the pixel unit. The grayscale value of a display image of the pixel unit is determined by the voltage difference between the data driving signal SD and the common voltage $V_{COM}$.

The gate driving signal SG is at high level during a charging period $T_C$ and a precharging period $T_P$. The high-level gate driving signal turns on the thin film transistor switches TFT in the corresponding pixel units. The data signal SD can thus be written into the liquid crystal capacitor $C_{LC}$ and the storage capacitor $C_{ST}$ in the corresponding pixel units, thereby changing the voltage levels of the corresponding pixel units.

In the prior art LCD device 200, the precharging period $T_P$ can increase the turn-on time of the thin film transistors TFT, thereby providing more time for the pixel units to reach target levels $V_{GH}$ or $V_{GL}$. However, precharging may result in over-charging which influences the display quality. For example, if the LCD device 200 adopts NW (normally white) liquid crystal material, bright images (white images) are presented when a smaller voltage $V_W$ or no voltage is applied, and dark images (black images) are presented when a larger voltage $V_B$ is applied. Under this circumstance, over-charging occurs when a black image of a red pixel unit drives a white image of a green pixel unit, or when a black image of a green pixel unit drives a white image of a blue pixel unit. Since $V_B>V_W$, when a pixel unit displaying a black image drives a pixel unit displaying a white image, the liquid crystal material needs to be discharged, and the voltage differences established on the green and blue pixel units may not reach the ideal value for displaying the white image. Therefore, the green and blue pixel units present darker display images, which in turn cause the entire display image to be over-reddish. Similarly, if the LCD device 200 adopts NB (normally black) liquid crystal material, bright images (white images) are presented when a larger voltage $V_W$ is applied, and dark images (black images) are presented when a smaller voltage $V_B$ is applied. Under this circumstance, over-charging occurs when a white image of a red pixel unit drives a black image of a green pixel unit, or when a white image of a green pixel unit drivers a black image of a blue pixel unit. Since $V_W>V_B$, when a pixel unit displaying a black image drives a pixel unit displaying a white image, the liquid crystal material needs to be discharged, and the voltage differences established on the green and blue pixel units may not reach the ideal value for displaying the white image. Therefore, the green and blue pixel units present darker display images, which in turn cause the entire display image to be over-reddish.

SUMMARY OF THE INVENTION

The present invention provides a liquid crystal display device with adaptive charging/discharging time including a plurality of gate lines for transmitting a plurality of gate driving signals; a plurality of data lines disposed perpendicular to the plurality of gate lines for transmitting a plurality of data driving signals; a pixel array comprising a plurality of pixel units each disposed at an intersection of a corresponding gate line and a corresponding data line and configured to display images according to a gate driving signal received from the corresponding gate line and a data driving signal received from the corresponding data line; a gate driver configured to output the plurality of gate driving signals according to an output enable signal; a timing controller configured to provide the output enable signal according to an optimized output enable reference value; and an optimization circuit configured to receive a first grayscale data corresponding to a display image of a row of pixel units among the plurality of pixel units in a first driving period, receive a second grayscale data corresponding to a display image of the row of pixel units in a second driving period subsequent to the first driving period, and provide the optimized output enable reference value for the row of pixel units in the second driving period according to a relationship between the first grayscale data and the second grayscale data.

The present invention further provides a method for driving a liquid crystal display device including receiving a first grayscale value corresponding to a display image of a pixel unit in a first driving period; receiving a second grayscale value corresponding to a display image of the pixel unit in a second driving period subsequent to the first driving period; and adjusting a charging time and a discharging time of the pixel unit in the second driving period according to a relationship between the first grayscale value and the second grayscale value.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIGS. 8-10 are diagrams illustrating the lookup table stored in the register according to the embodiments of the present invention.

DETAILED DESCRIPTION

Figure 1:
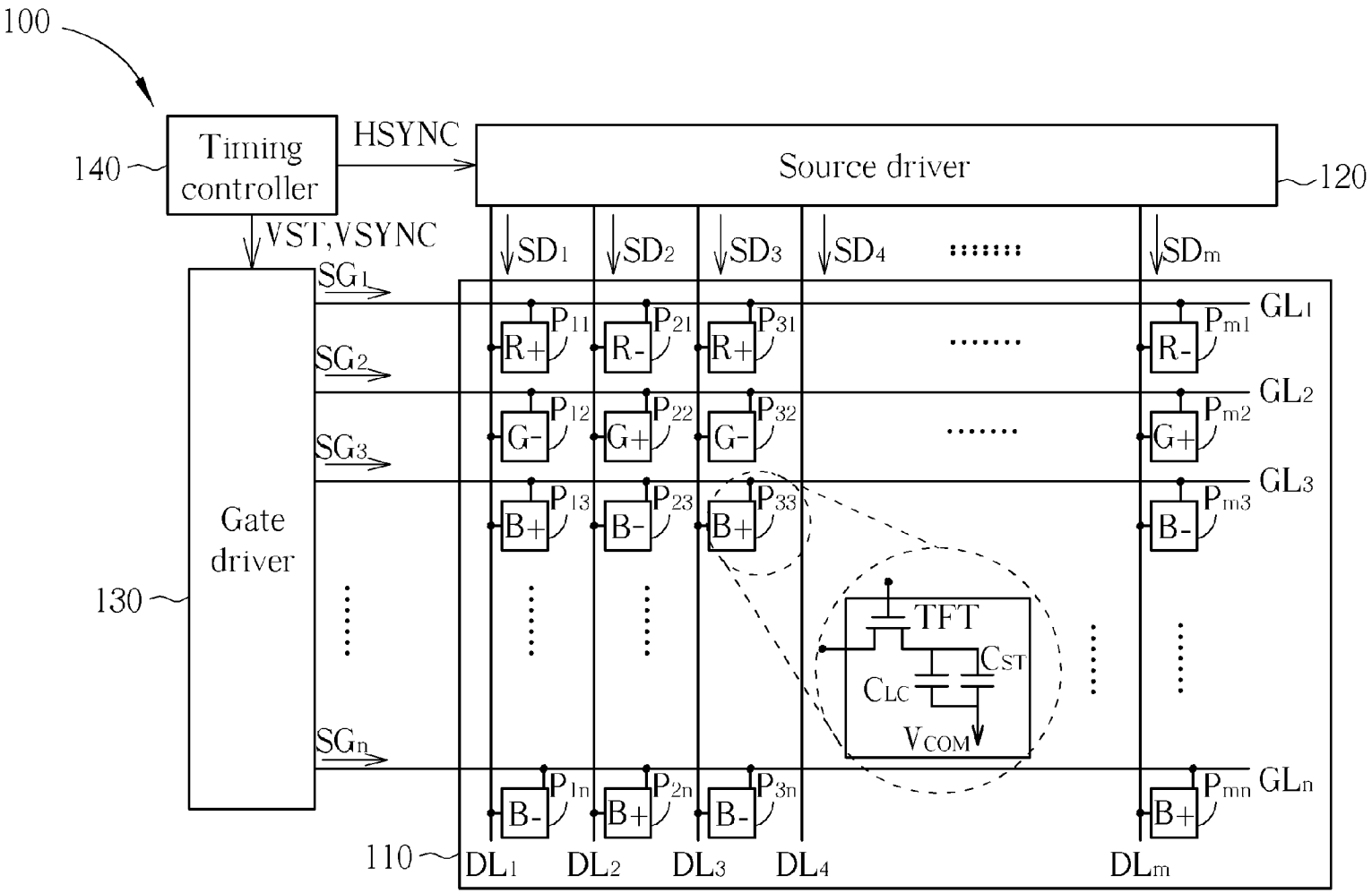
FIG. 1 PRIOR ART
FIG. 1 is a diagram illustrating a prior art LCD device.
Figure 2:
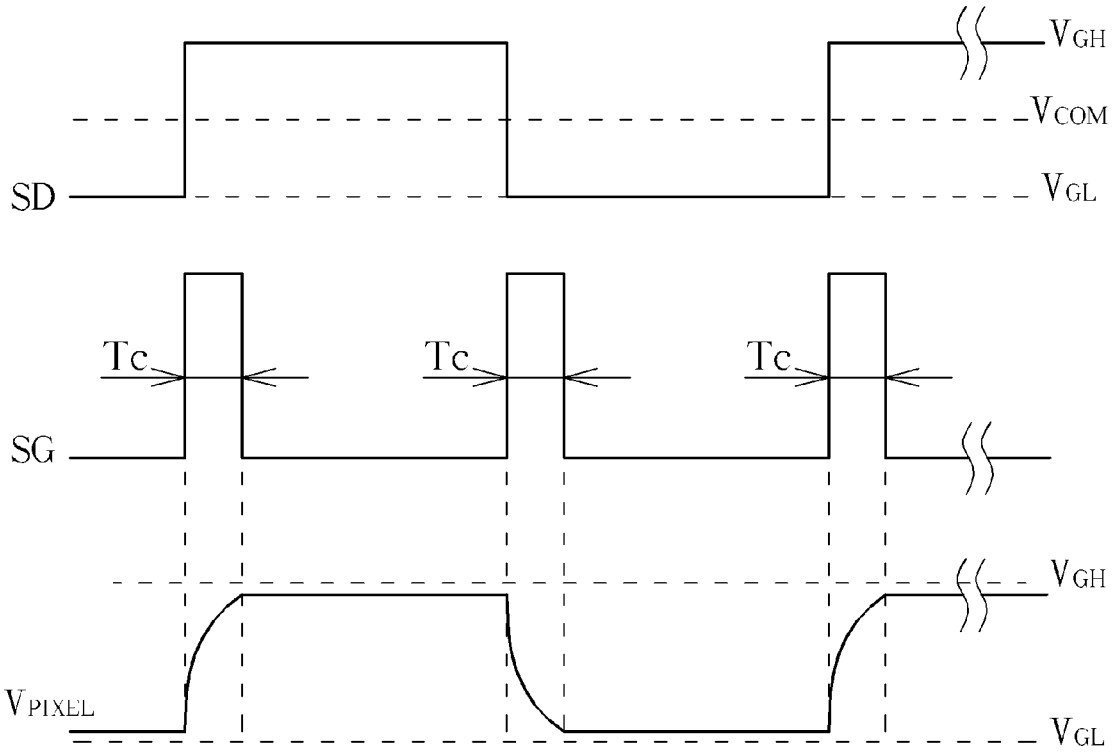
FIG. 2 PRIOR ART
FIG. 2 is a timing diagram illustrating the operation of the LCD device in FIG. 1.
Figure 3:
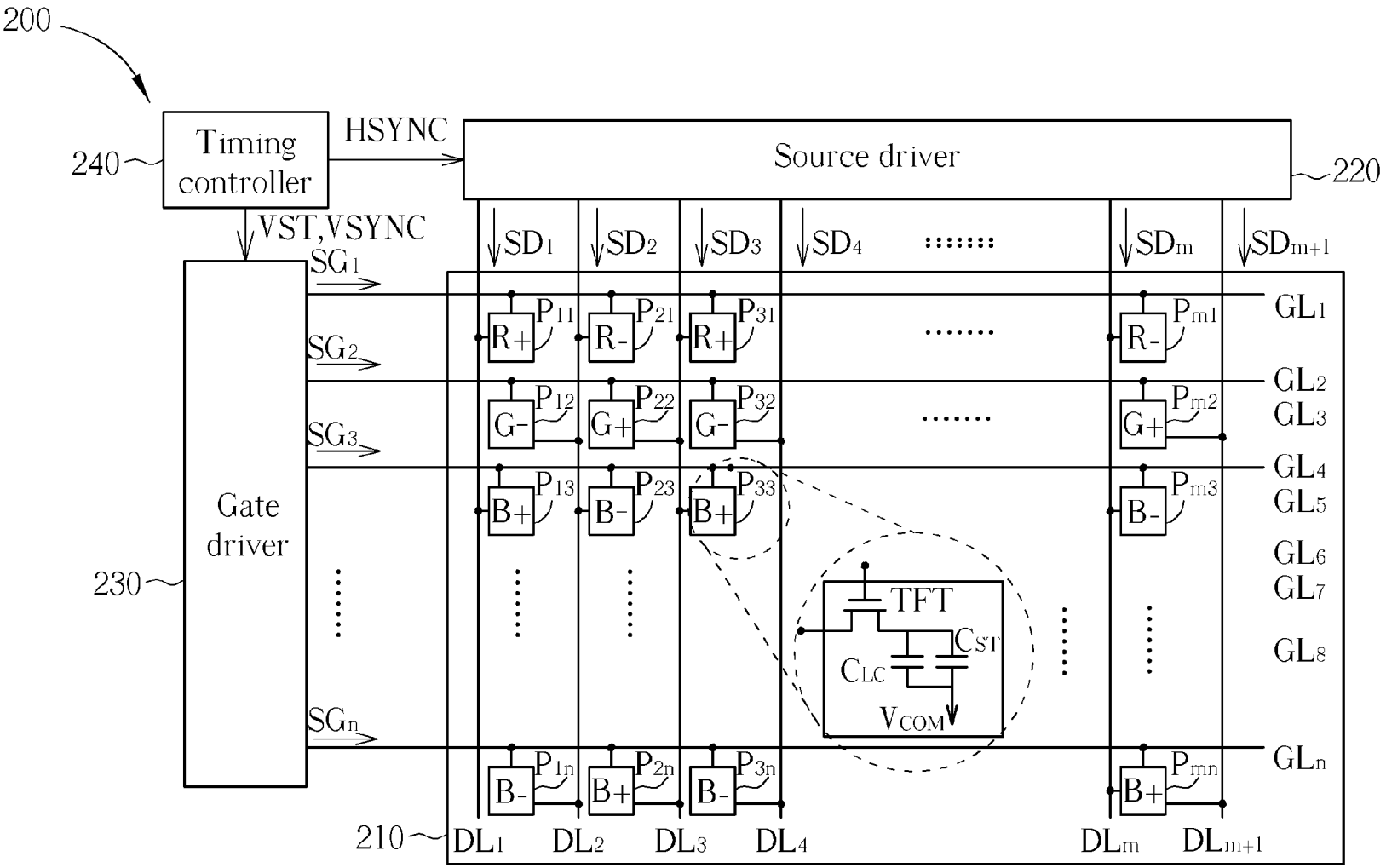
FIG. 3 PRIOR ART
FIG. 3 is a diagram illustrating another prior art LCD device.
Figure 4:
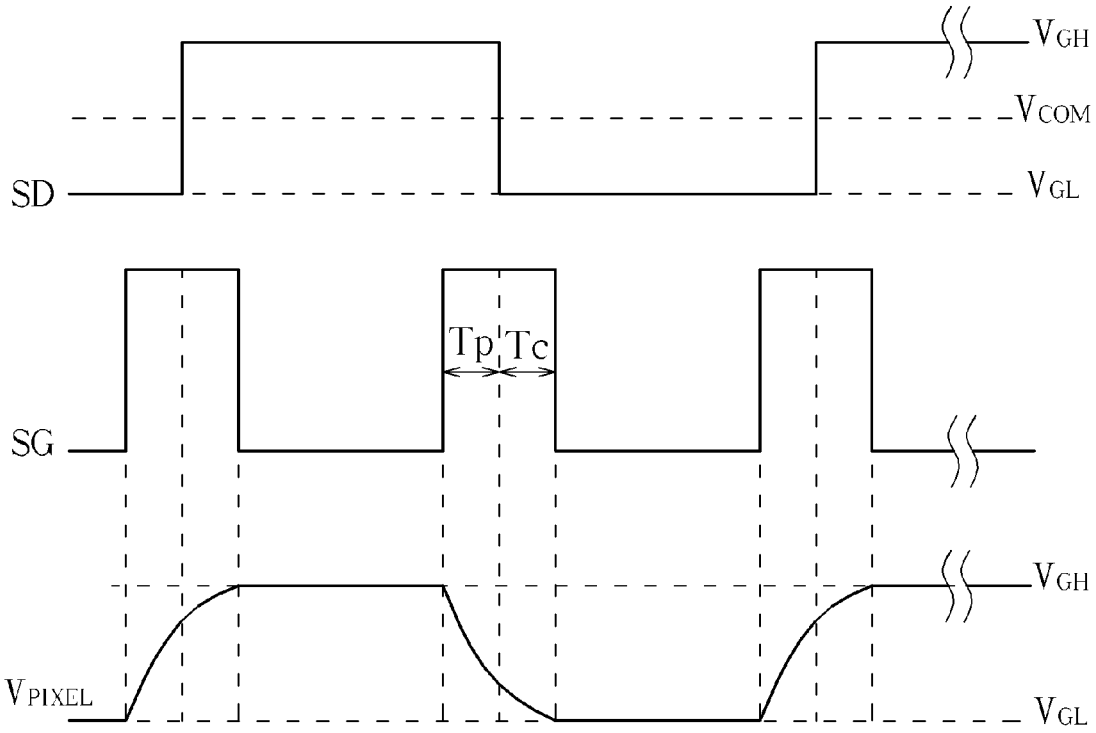
FIG. 4 PRIOR ART
FIG. 4 is a timing diagram illustrating the operation of the LCD device in FIG. 3.
Figure 5:
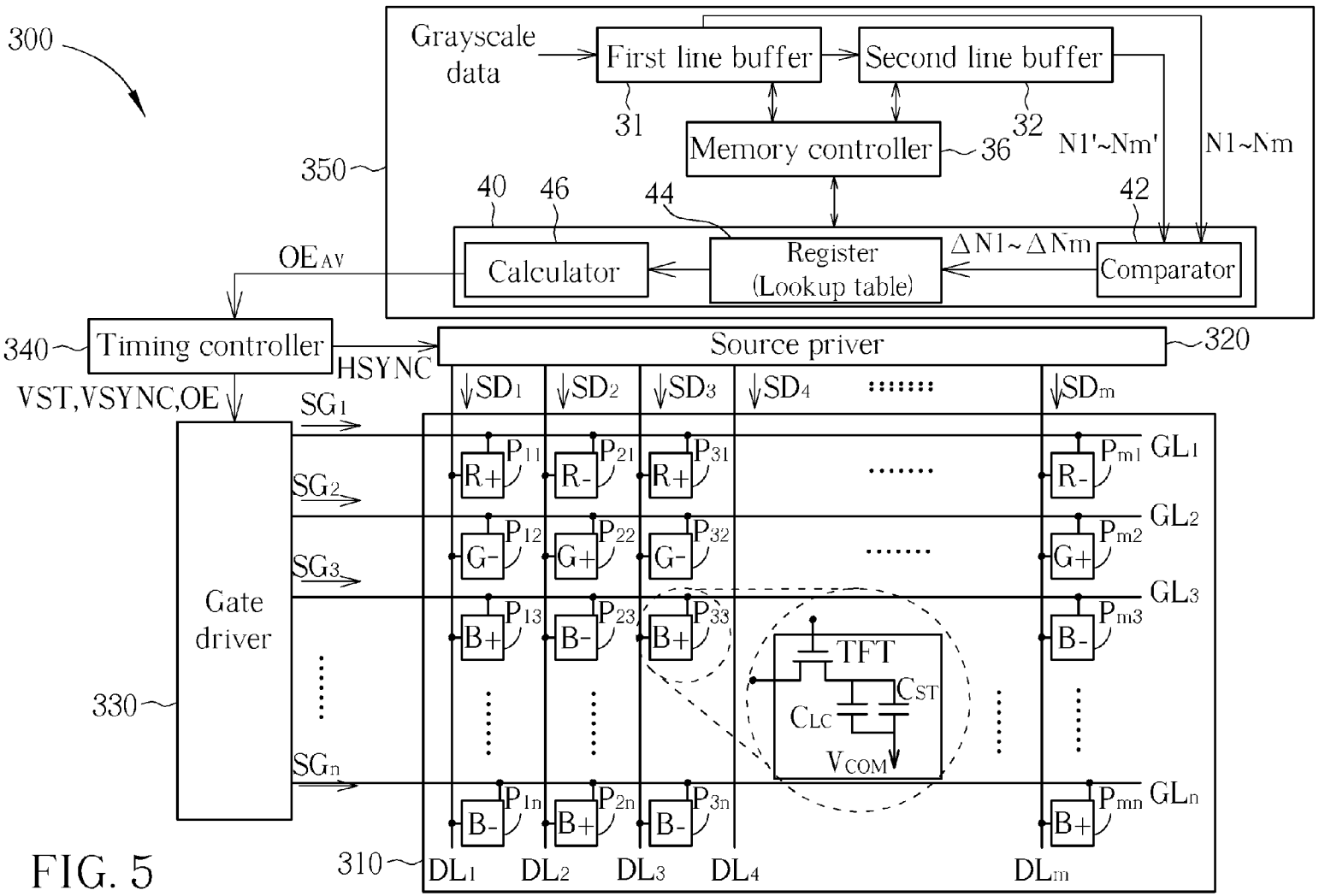
FIG. 5 is a diagram illustrating an LCD device according to a first embodiment of the present invention.
Figure 6:
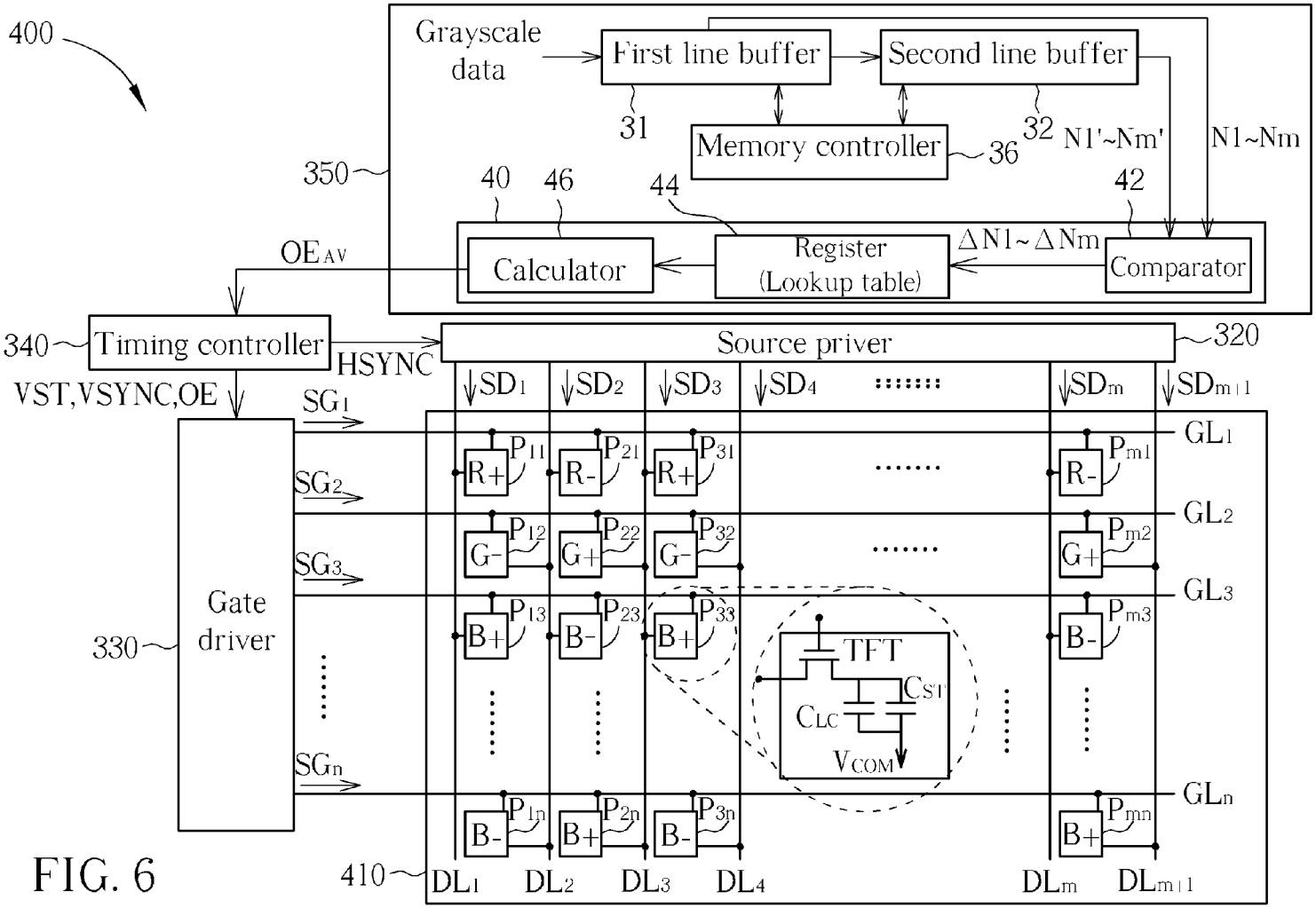
FIG. 6 is a diagram illustrating an LCD device according to a second embodiment of the present invention.

FIG. 5 is a diagram illustrating an LCD device 300 according to a first embodiment of the present invention. FIG. 6 is a diagram illustrating an LCD device 400 according to a second embodiment of the present invention. The LCD devices 300 and 400 each include a source driver 320, a gate driver 330, a timing controller 340, and an optimization circuit 350. In the LCD device 300 according to the first embodiment of the present invention, a plurality of data lines $DL_1$-$DL_m$, a plurality of gate lines $GL_1$-$GL_n$, and a pixel array are disposed on an LCD panel 310. The pixel array includes a plurality of pixel units $P_{11}$-$P_{mn}$ each having a thin film transistor switch TFT, a liquid crystal capacitor $C_{LC}$ and a storage capacitor $C_{ST}$. Each pixel unit of the LCD device 300, coupled to a corresponding data line, a corresponding gate line, and a common voltage $V_{COM}$, receives data driving signals from the corresponding data line disposed at the left side. In the LCD device 400 according to the second embodiment of the present invention, a plurality of data lines $DL_1$-$DL_{m+1}$, a plurality of gate lines $GL_1$-$GL_n$, and a pixel array are disposed on an LCD panel 410. The pixel array includes a plurality of pixel units $P_{11}$-$P_{mn}$ each having a thin film transistor switch TFT, a liquid crystal capacitor $C_{LC}$ and a storage capacitor $C_{ST}$. The LCD device 400 adopts a zigzag layout in which the odd-numbered rows of pixel units $P_{11}$-$P_{m1}$, $P_{13}$-$P_{m3}$, . . . , $P_{1(n-1)}$-$P_{m(n-1)}$ receive data driving signals from the corresponding data lines disposed at the left side, while the even-numbered rows of pixel units $P_{12}$-$P_{m2}$, $P_{14}$-$P_{m4}$, . . . , $P_{1n}$-$P_{mn}$ receive data driving signals from the corresponding data lines disposed at the right side (assuming n is an even number). In the LCD devices 300 and 400, the type and polarity of each pixel unit are represented by "R" (red pixel), "G" (green pixel), B" (blue pixel), "+" (positive polarity) and "–" (negative polarity) in FIGS. 5 and 6.

The timing controller 340 is configured to generate control signals for operating the source driver 320 and the gate driver 330, such as an output enable signal OE, a start pulse signal VST, a horizontal synchronization signal HSYNC, and a vertical synchronization signal VSYNC. According to the output enable signal OE, the start pulse signal VST and the vertical synchronization signal VSYNC, the gate driver 330 respectively outputs gate driving signals $SG_1$-$SG_n$ to the gate lines $GL_1$-$GL_n$, thereby turning on the thin film transistor switches TFT in the corresponding rows of pixel units. According to the horizontal synchronization signal HSYNC, the source driver 320 respectively outputs data driving signals $SD_1$-$SD_{m+1}$ related to display images to the data lines $DL_1$-$DL_{m+1}$, thereby charging the liquid crystal capacitors $C_{LC}$ and the storage capacitors $C_{ST}$ in the corresponding columns of pixel units.

On the other hand, the LCD devices 300 and 400 of the present invention provide an output enable reference value $OE_{AV}$ corresponding to the optimized charging time of each row of pixel units using the optimization circuit 350. The timing controller 340 can thus generate the output enable signal OE according to the output enable reference value $OE_{AV}$. The optimization circuit 350 includes two line buffers 31 and 32, a memory controller 36 and a judging circuit 40. The memory controller 36 is configured to control the data transmission between the line buffer 31, the line buffer 32 and the judging circuit 40. The grayscale data of a pixel unit is first stored in the first line buffer 31. Upon receiving the grayscale data of the next driving period, the first line buffer 31 outputs the original grayscale data from the previous driving period. For the row of pixel units $P_{11}$-$P_{1m}$ coupled to the gate line $GL_1$, the respective target grayscale values N1-Nm in the charging period are stored in the first line buffer 31, while the respective previous grayscale values N1'-Nm' in the pre-charging period are stored in the second line buffer 32.

The judging circuit 40 includes a comparator 42, a register 44 and a calculator 46. The comparator 42 receives the target grayscale values N1-Nm from the first line buffer 31 and the previous grayscale values N1'-Nm' from the second line buffer 32, thereby generating the difference values ΔN1-ΔNm respectively corresponding to the differences between the target grayscale values N1-Nm and the previous grayscale values N1'-Nm'. The register 44 stores a lookup table (LUT), based on which reference values OE1-OEm respectively corresponding to the difference values ΔN1-ΔNm are transmitted to the calculator 46. The calculator 46 can thus generate the output enable reference value $OE_{AV}$ corresponding to the optimized charging time of each row of pixel units $P_{11}$-$P_{1m}$ according to the reference values OE1-OEm of each pixel unit. The timing controller 340 can thus output the optimized output enable signal OE according to the output enable reference value $OE_{AV}$. In other words, the present invention provides an output enable reference value $OE_{AV}$ of a pixel unit according to a previous grayscale value and a target grayscale value from two adjacent driving periods. The optimized output enable signal OE of a specific gate line can be provided by averaging all output enable reference values $OE_{AV}$ of the pixel units coupled to this specific gate line.

Figure 7:
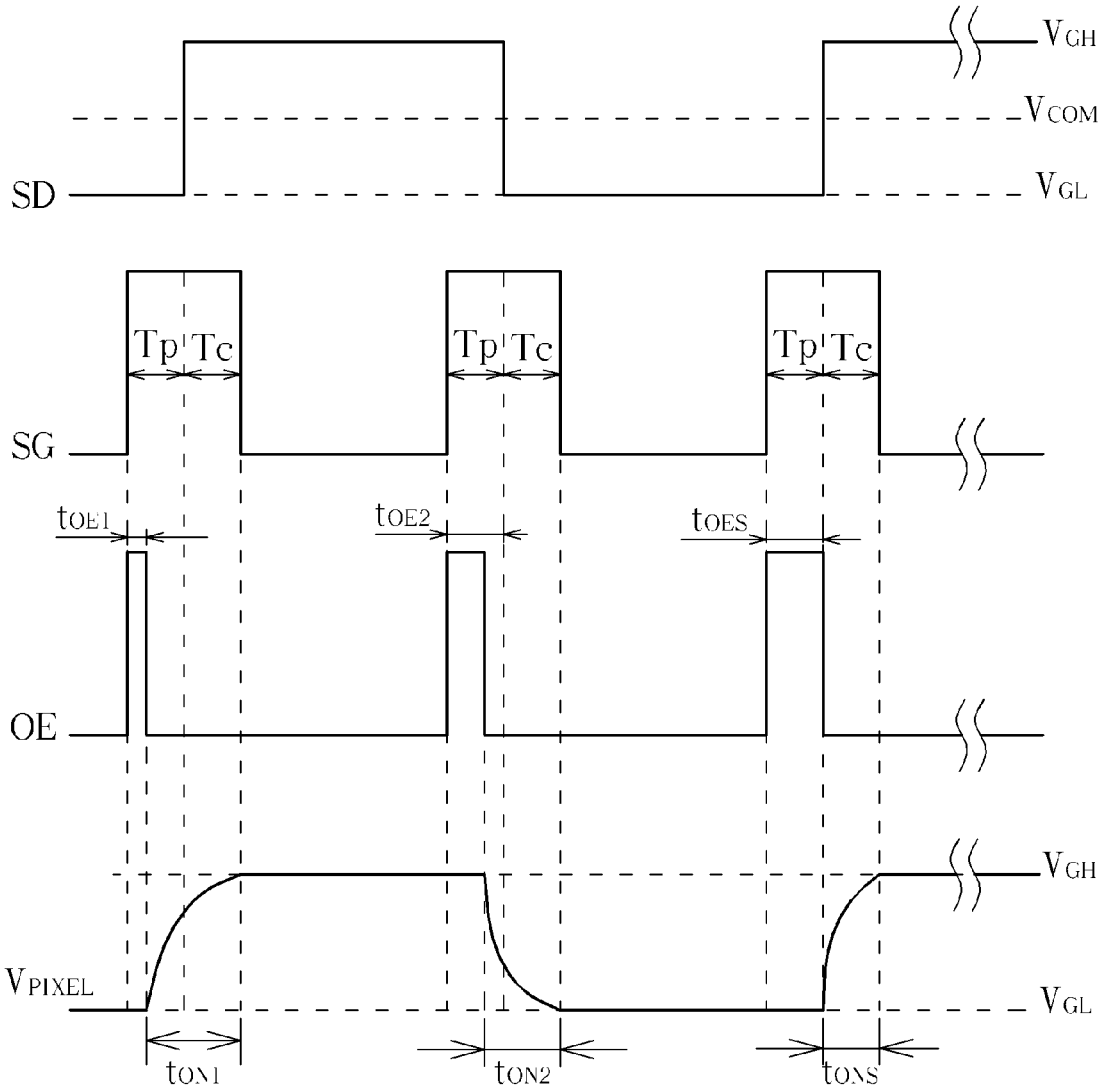
FIG. 7 is a timing diagram illustrating the operation of the LCD device according to the embodiments of the present invention.

Reference is made to FIG. 7 for a timing diagram illustrating the operation of the LCD device 300. In FIG. 7, SG represents the waveform of the gate driving signal, SD represents the waveform of the data driving signal, and $V_{PIXEL}$ represents the voltage level of the pixel unit. S output enable signals are used for driving the LCD device 300. The gate driving signal SG is at high level during the precharging period $T_P$ and the charging period $T_C$. The output enable signal OE is at high level during the periods $t_{OE1}$-$t_{OES}$. In the present invention, the gate driver 330 outputs the gate driving signals to corresponding gate lines when the output enable signal OE is at low level. The actual turn-on time $t_{ON1}$-$t_{ONS}$ of the thin film transistor switches TFT in the pixel units are determined by the high-level periods $t_{OE1}$-$t_{OES}$ of the output enable signal OE. In other words, $t_{ON1}=(T_P+T_C-t_{OE1})$, $t_{ON2}=(T_P+T_C-t_{OE2})$, . . . , $t_{POS}=(T_P+T_C-t_{OES})$. The optimization circuit 350 of the present invention adjusts the length of the high-level periods $t_{OE1}$-$t_{OES}$ of the output enable signal OE according to the difference values ΔN1-ΔNm which respectively correspond to the differences between the target grayscale values N1-Nm and the previous grayscale values N1'-Nm'. Therefore, each row of pixel units can be driven by the optimized output enable signal OE.

FIG. 8 is a diagram illustrating the lookup table stored in the register 44 according to an embodiment of the present invention. Assuming that the image grayscale value ranges between 0-255 and a judging region includes 16 grayscale values, the horizontally-listed previous grayscale values include 16 judging regions, and the vertically-listed target grayscale values also include 16 judging regions. Meanwhile, the lookup table stored in the register 44 provides 3 reference values corresponding to output enable signals having high-level periods of 0.5 us, 1 us and 2 us, respectively. For the pixel units $P_{11}$ among the first row of pixel units $P_{11}$-$P_{1m}$, if the target grayscale value N1 is within a judging region having larger grayscale values and the previous grayscale value N1' is within a judging region having smaller grayscale values, the charging/discharging processes need to proceed by rotating the liquid crystal molecules with larger angles and applying data driving signals which establish larger voltage difference. Under this circumstance, the thin film transistor TFT of the pixel unit $P_{11}$ requires the longest turn-on time, and the register 44 thus outputs the reference value OE1 corresponding to 0.5 us; if the target grayscale value N1 and the previous grayscale value N1' are within the same judging region, no extra charging/discharging is required. Under this circumstance, the thin film transistor TFT of the pixel unit $P_{11}$ requires the shortest turn-on time, and the register 44 thus outputs the reference value OE1 corresponding to 2 us; if the target grayscale value N1 is within a judging region having smaller grayscale values and the previous grayscale value N1' is within a judging region having larger grayscale values, charging/discharging is required. Under this circumstance, the thin film transistor TFT of the pixel unit $P_{11}$ requires longer turn-on time than that required when the grayscale values of two adjacent driving periods remain unchanged. The register 44 thus outputs the reference value OE1 corresponding to 1 us. As previously illustrated, the reference values OE1-OEm of the first row of pixel units $P_{11}$-$P_{1m}$ can be acquired in the same manner. The calculator 46 can provide the output enable reference value $OE_{AV}$ corresponding to the optimized charging time of pixel units $P_{11}$-$P_{1m}$ by, for instance, averaging the reference values OE1-OEm. The timing controller 340 can then provide the optimized output enable signal OE according to the output reference value $OE_{AV}$. The numbers in the lookup table depicted in FIG. 8 are merely for illustrative purpose, and do not limit the scope of the present invention.

FIG. 9 is a diagram illustrating the lookup table stored in the register 44 according to another embodiment of the present invention. Assuming that the image grayscale value ranges between 0-255 and a judging region includes a single grayscale value, the horizontally-listed previous grayscale values include 256 judging regions, and the vertically-listed target grayscale values also include 256 judging regions. Meanwhile, the lookup table stored in the register 44 provides 3 reference values corresponding to output enable signals having high-level periods of 0.5 us, 1 us and 2 us, respectively. For the pixel units $P_{11}$ among the first row of pixel units $P_{11}$-$P_{1m}$, if the target grayscale value N1 is larger than the previous grayscale value N1', the charging/discharging processes need to proceed by rotating the liquid crystal molecules with larger angles and applying data driving signals which establish larger voltage difference. Under this circumstance, the thin film transistor TFT of the pixel unit $P_{11}$ requires the longest turn-on time, and the register 44 thus outputs the reference value OE1 corresponding to 0.5 us; if the target grayscale value N1 is equal to the previous grayscale value N1', no extra charging/discharging is required. Under this circumstance, the thin film transistor TFT of the pixel unit $P_{11}$ requires the shortest turn-on time, and the register 44 thus outputs the reference value OE1 corresponding to 2 us; if the target grayscale value N1 is smaller than the previous grayscale value N1', charging/discharging is required. Under this circumstance, the thin film transistor TFT of the pixel unit $P_{11}$ requires longer turn-on time than that required when the grayscale values of two adjacent driving periods remain unchanged. The register 44 thus outputs the reference value OE1 corresponding to 1 us. As previously illustrated, the reference values OE1-OEm of the first row of pixel units $P_{11}$-$P_{1m}$ can be acquired in the same manner. The calculator 46 can provide the output enable reference value $OE_{AV}$ corresponding to the optimized charging time of pixel units $P_{11}$-$P_{1m}$ by, for instance, averaging the reference values OE1-OEm. The timing controller 340 can then provide the optimized output enable signal OE according to the output reference value $OE_{AV}$. The numbers in the lookup table depicted in FIG. 8 are merely for illustrative purpose, and do not limit the scope of the present invention.

FIG. 10 is a diagram illustrating the lookup table stored in the register 44 according to another embodiment of the present invention. Assume that the image grayscale value ranges between 0-255 and the lookup table stored in the register 44 provides 257 reference values respectively corresponding to output enable signals having high-level periods of $T_{MAX}$ and $T_0$-$T_{255}$, wherein $T_{MAX}>T_0>T_1>\ldots>T_{255}$. For the pixel units $P_{11}$ among the first row of pixel units $P_{11}$-$P_{1m}$, assume that the target grayscale value N1 is larger than the previous grayscale value N1'. When the differences between the target grayscale value N1 and the previous grayscale value N1' are 1-255, the register 44 outputs the reference value OE1 respectively corresponding to $T_1$-$T_{255}$. Since $T_1>T_2>\ldots>T_{255}$, as the difference between the target grayscale value N1 and the previous grayscale value N1' increases, the pixel units $P_{11}$ can be charged/discharged by rotating the liquid crystal molecules with larger angles and applying data driving signals which establish larger voltage difference; if the target grayscale value N1 is equal to the previous grayscale value N1', no extra charging/discharging is required. Under this circumstance, the thin film transistor TFT of the pixel unit $P_{11}$ requires the shortest turn-on time, and the register 44 thus outputs the reference value OE1 corresponding to $T_{MAX}$; if the target grayscale value N1 is smaller than the previous grayscale value N1', charging/discharging is required. Under this circumstance, the thin film transistor TFT of the pixel unit $P_{11}$ requires longer turn-on time than that required when the grayscale values of two adjacent driving periods remain unchanged. The register 44 thus outputs the reference value OE1 corresponding to $T_0$. As previously illustrated, the reference values OE1-OEm of the first row of pixel units $P_{11}$-$P_{1m}$ can be acquired in the same manner. The calculator 46 can provide the output enable reference value $OE_{AV}$ corresponding to the optimized charging time of pixel units $P_{11}$-$P_{1m}$ by, for instance, averaging the reference values OE1-OEm. The timing controller 340 can then provide the optimized output enable signal OE according to the output reference value $OE_{AV}$.

The optimization circuit 350 of the present invention adjusts the length of the high-level periods of the output enable signal OE according to the difference values ΔN1-ΔNm which respectively correspond to the differences between the target grayscale value and the previous grayscale value of each pixel unit. Therefore, each row of pixel units can be driven by the optimized output enable signal OE, thereby largely improving the display quality.

Those skilled in the art will readily observe that numerous modifications and alterations of the device and method may be made while retaining the teachings of the invention.

What is claimed is:

1. A method for driving a liquid crystal display (LCD) device comprising:

receiving a first grayscale value corresponding to a display image of a pixel unit in a first driving period;

receiving a second grayscale value corresponding to a display image of the pixel unit in a second driving period subsequent to the first driving period; and adjusting a charging time and a discharging time of the pixel unit in the second driving period according to a relationship between the first grayscale value and the second grayscale value by:

decreasing the charging time and the discharging time of the pixel unit in the second driving period when the first grayscale value is within a first judging region, the second grayscale value is within a second judging region, and the first judging range includes larger grayscale values than the second judging region; or increasing the charging time and the discharging time of the pixel unit in the second driving period when the first grayscale value is within a third judging region, the second grayscale value is within a fourth judging region, and the third judging range includes smaller grayscale values than the fourth judging region.

2. The method of claim 1 further comprising:

receiving a plurality of first grayscale values corresponding to display images of a row of pixel units in the first driving period;

receiving a plurality of second grayscale values corresponding to display images of the row of pixel units in the second driving period; and adjusting a charging time and a discharging time of the row of pixel units in the second driving period according to a relationship between the plurality of first grayscale values and the corresponding plurality of second grayscale values.

3. The method of claim 2 further comprising:

calculating a plurality of difference values which are associated with differences between the plurality of first grayscale values and the corresponding plurality of second grayscale values;

calculating an average value of the plurality of difference values; and adjusting the charging time and the discharging time of the pixel unit in the second driving period according to the average value.

* * * * *